US007327086B2

(12) United States Patent
Tiesler-Wittig

(10) Patent No.: US 7,327,086 B2
(45) Date of Patent: Feb. 5, 2008

(54) GAS-DISCHARGE LAMP WITH A COLOUR-COMPENSATING FILTER

(75) Inventor: Helmut Tiesler-Wittig, Langerwehe (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 232 days.

(21) Appl. No.: 10/511,370

(22) PCT Filed: Apr. 14, 2003

(86) PCT No.: PCT/IB03/01449

§ 371 (c)(1),
(2), (4) Date: Oct. 14, 2004

(87) PCT Pub. No.: WO03/090250

PCT Pub. Date: Oct. 30, 2003

(65) Prior Publication Data

US 2005/0140292 A1 Jun. 30, 2005

(30) Foreign Application Priority Data

Apr. 19, 2002 (DE) ..... 102 17 480

(51) Int. Cl.
*H01J 61/35* (2006.01)
*H01J 61/40* (2006.01)

(52) U.S. Cl. ..... 313/635; 313/112

(58) Field of Classification Search ..... 313/634, 313/635, 112, 117
See application file for complete search history.

(56) References Cited

U.S. PATENT DOCUMENTS

| | | | | | |
|---|---|---|---|---|---|
| 4,307,315 | A | * | 12/1981 | Meulemans et al. | 313/44 |
| 4,864,180 | A | * | 9/1989 | English et al. | 313/44 |
| 5,039,912 | A | * | 8/1991 | Van Vliet et al. | 313/25 |
| 5,111,105 | A | * | 5/1992 | Yamamoto | 313/112 |
| 5,587,626 | A | * | 12/1996 | Parham et al. | 313/634 |
| 5,608,227 | A | * | 3/1997 | Dierks et al. | 250/492.1 |
| 5,646,471 | A | * | 7/1997 | Scholler et al. | 313/25 |
| 5,952,768 | A | * | 9/1999 | Strok et al. | 313/110 |
| 6,015,592 | A | * | 1/2000 | Mifune et al. | 427/376.2 |
| 6,411,021 | B1 | * | 6/2002 | Izawa et al. | 313/315 |
| 6,530,678 | B1 | * | 3/2003 | Kirsten | 362/293 |
| 6,583,564 | B1 | * | 6/2003 | Kiryu et al. | 313/634 |

FOREIGN PATENT DOCUMENTS

| | | | |
|---|---|---|---|
| DE | 10012827 | | 9/2000 |
| EP | 0935277 | A1 | 8/1999 |
| EP | 935277 | A1 * | 8/1999 |
| EP | 0935277 | B1 | 12/2004 |

* cited by examiner

*Primary Examiner*—Joseph Williams

(57) ABSTRACT

A gas-discharge lamp includes a discharge vessel, two electrodes, a cap, an outer envelope, and a filling of a metal halide. To improve the quality of the beam color, the outer envelope of the gas-discharge lamp is partially coated with an optical compensating filter of a color complementary to the color of the metal halide. By partially coating the outer envelope with the compensating filter, an unwanted coloration in the beam is corrected.

11 Claims, 1 Drawing Sheet

GAS-DISCHARGE LAMP WITH A COLOUR-COMPENSATING FILTER

Figure 1:
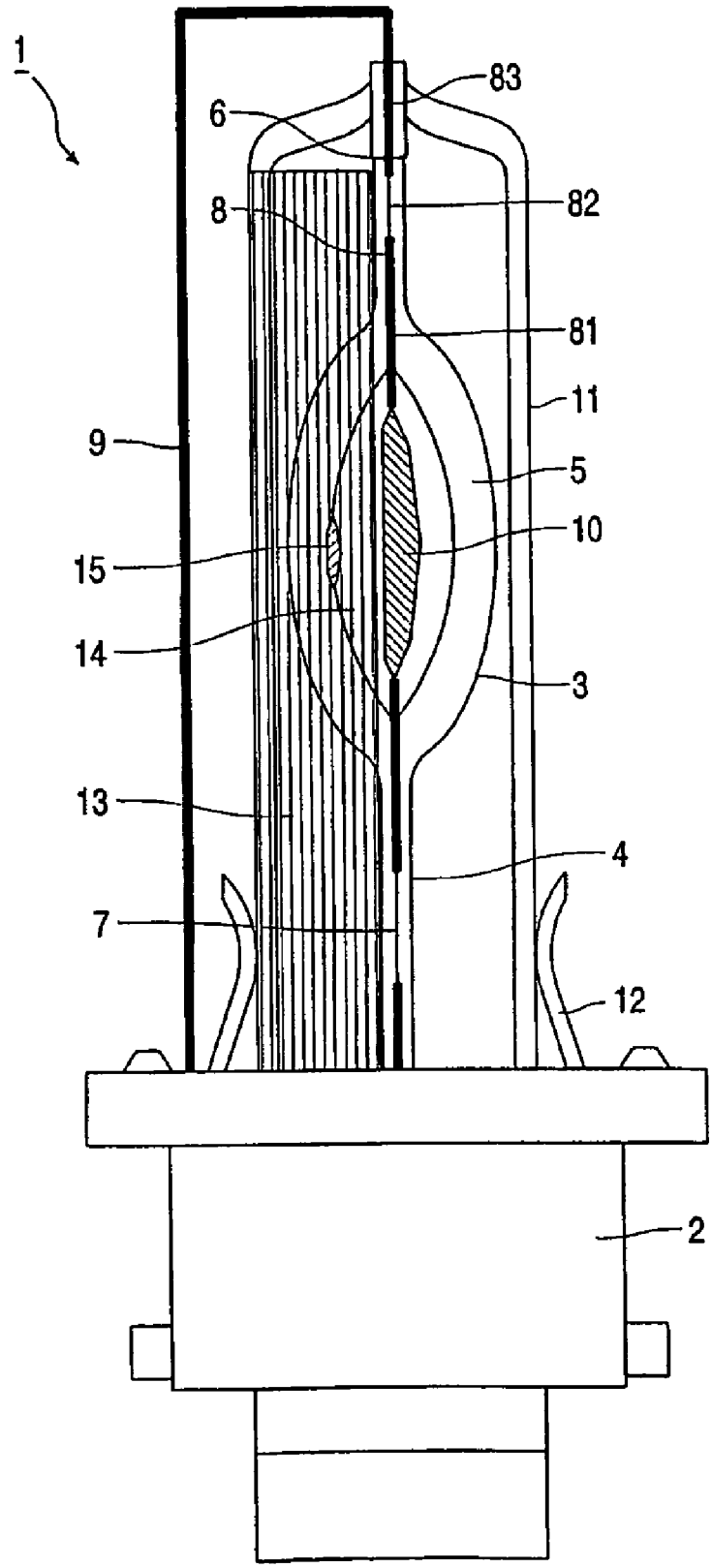

The invention relates to a gas-discharge lamp having a discharge vessel, two electrodes, a cap, an outer envelope, and a filling in the discharge vessel comprising a metal halide.

Gas-discharge lamps of this kind are used in particular as light sources for the headlight systems of motor vehicles, because the optical properties of gas-discharge lamps provide a range of advantages (such as more light, for example). The filling in the discharge vessel permanently regenerates the discharge plasma, and lamps of this kind require a proportion of metal halide (salt proportion) in their filling in order to control the color of the light and the efficacy of the lamp. While the lamp is operating, this salt proportion in the filling forms a yellowish condensate, which is generally situated at the bottom of the vessel. When the image of the lamp is reproduced by the optical system of the headlight, this yellowish area is also shown in the headlight beam. The yellowish area is then typically situated in the front part of the beam on the road.

A capped high-pressure gas-discharge lamp of the generic kind is known, for example, from U.S. Pat. No. 5,646,471. This lamp has a discharge vessel that is surrounded by an outer envelope. An appropriately designed cap makes it particularly suitable for use as a motor vehicle lamp. Contacts arranged in the cap are connected via supply conductors to corresponding electrodes that project into the discharge vessel. A neck-shaped end of the discharge vessel is fixed in place in the cap, while a second, opposing end, which is also neck-shaped, is arranged to be free. Arranged to be tightly sealed in each of the ends are respective electrodes, of which an inner portion projects into the discharge vessel and is connected to an outer portion via a molybdenum foil in the seal. The electrode at the free end is connected to the corresponding contact in the cap via a supply conductor that extends along the outside of the outer envelope. This supply conductor is provided with a small insulating ceramic pipe. The purpose of the outer envelope in this case is to reduce the temperature differences in the discharge vessel, as a result of which it is possible to obtain a higher luminous flux while power consumption remains the same. Because of the outer envelope, it is also possible to obtain a reduction in the maximum temperature of the discharge vessel without reducing the luminous flux in comparison with a lamp not having an outer envelope. The outer envelope may be surrounded by a light-absorbing coating that covers at least a certain zone. The longitudinal extension of this zone is defined by a certain angular range. The coating is arranged at the first end of the lamp that is fixed in place in the cap and that is situated opposite the free end. A light source designed in this way is ideally suited for use in so-called projection headlights, where the light emitted is collected in an elliptical mirror in such a way that an image of it, together with a mask for stray light, is formed on the road by a projecting lens. To allow the light source to be used in headlights having so-called reflection systems, there is also applied to the side of the outer envelope, along the discharge arc, a band-shaped coating that, in optical systems of this kind, performs the function of the mask for stray light. The width of the bands is set by certain angles between the corresponding edges of the bands on the outer envelope. The intention of the coating and of the way in which it is sized is that, when the lamp is operating in a motor vehicle headlight, any glare caused by stray light emitted by the lamp is avoided. Consequently, what is provided is an absorption filter that totally blocks radiation in the areas in question. Hence, with this lamp, the salt filling also produces a yellowish condensate of which, in operation, an image is formed by the optical system as a yellowish area in the beam of light.

German application laid open to public inspection DE100 12 827 A1 describes an arc-discharge lamp that is operated in, for example, main headlights of automobiles. The lamp comprises an arc-discharge tube of light-transmitting material such as quartz and a first and a second end having a first hollow therebetween. An electrode is sealed into each of the first and second ends. Each electrode comprises an external portion, an intermediate portion of molybdenum foil, and an internal portion, the portions being formed from tungsten or tungsten alloy. After the description, the application looks at the problem of the point where the halogen metal salts that are contained in the filling of the arc-discharge lamp are deposited. Particularly when lamps of low power (up to 100 W) are used for main headlight applications, annoying bands of color occur that are caused by changes in the additives. This problem becomes more significant when the lamp is combined with a reflector. According to the application, there is provided in the lamps a second hollow that is formed in one of the ends of the arc-discharge tube, the second hollow being offset from the first but connected thereto. The second hollow provides a unique cold spot and acts as a vessel for those additives that are not vaporized. When the lamp is operating, the second hollow acts as a reservoir and contains excess halogen metal in an unvaporized state. This reservoir removes materials that are not needed and the latter are therefore unable to adversely affect the optics of the lamp or to produce bands of color.

In this lamp a second hollow has to be produced at some cost and effort, for which reason the manufacturing process for the discharge vessel has to be appreciably revised and extended. This makes production more complicated and more prone to producing lamps having faulty discharge vessels.

It is therefore an object of the invention to provide a gas-discharge lamp that is easily able to give better color rendering, particularly for applications in optical imaging systems such as reflectors.

This object is achieved in that the outer envelope of the gas-discharge lamp is partly coated with an optical compensating filter of the color complementary to the color of the metal halide. In gas-discharge lamps of the generic type, a coloration is produced by that proportion of salts in the gas filling that is not in a gaseous state when the lamp is operating. The yellowish condensate in the discharge vessel is struck by the light from the discharge arc and produces an area having a yellowish coloration. By partly coating the outer envelope with a compensating filter, the unwanted coloration in the beam of light generated can be corrected if the filter is of the appropriate complementary color. By applying the filter to the outer envelope, the colored area is corrected before an image of the arc is formed by an optical system. The coating with a compensating filter is only partial, and because of this and in contrast to a complete coating, as little as possible of the radiation generated is filtered and absorbed. The brightness and luminous efficacy of the lamp are reduced to an appreciably smaller degree. The compensating filter can easily be adjusted to suit the color of the salt proportion if, for functional reasons for example, the composition of the proportion is varied. The extent of the coating may be adjusted likewise, as a function of the extent and amount of the salt condensate.

It is particularly advantageous in this case if the compensating filter is applied in that region of the outer envelope which, when the lamp is fitted and operating, is the bottom region of the outer envelope. The proportion of salts in the filling that is non-gaseous in operation generally deposits in the bottom region of the discharge vessel. Hence, the compensating filter is also applied in that bottom region of the outer envelope which is adjacent the position of the yellowish condensate. In operation, the lamp is generally fitted in a horizontal position. The compensating filter is then applied to the bottom half-cylinder of the outer envelope.

For advantageous further embodiments of the lamp according to the invention, the compensating filter comprises an interference filter. The particular advantage of the use of an interference filter as the compensating filter is that the filter color can be very accurately set by selecting the layers of the interference filter. This can easily be done because the technique concerned is one that has been fully mastered and it is easily possible for the outer envelope, which is generally made of quartz, to be coated.

In another embodiment of the lamp according to the invention, the compensating filter comprises an absorption filter. By using an absorption filter, it is even possible for the perceived color to be shifted towards the filter color blue. Technical implementation can be achieved by using a dip process, for example, in which the burner mounted in the outer envelope is dipped.

As well as this, an additional optical filter for color-shifting purposes may be provided, by which the overall perceived color from the lamp is changed. Color-shifting filters specifically matched to the compensating filter can shift the perceived color towards a blue or a yellow coloration, for example. Colorations of this kind are used particularly in motor vehicle lamps to improve the quality of the light or for special viewing conditions.

In an advantageous embodiment of the lamp, provision is made for the compensating filter to be applied in that region of the outer envelope that, in a lamp which is fitted and operating, is adjacent that region of the discharge vessel in which the non-gaseous proportion of the metal halide is situated. By lining the partial compensating filter up with the non-gaseous proportion and the arc, an exact correction is obtained without the color reproduction of the beam produced by the lamp being changed to any unnecessary degree. In this case, the partial compensating filter must cover at least the range that ensures correction of the yellowish coloration in the beam. Hence, its minimum size depends on the position and size of the condensate and the arc. When the lamp is used in an optical imaging system such as a reflector, the partial compensating filter can be optimized such that the colored region is corrected in the beam that is produced by forming an image of the arc. The compensating filter would be adjusted to the particular optical system in this case.

The coating forming the compensating filter is advantageously and simply applied by a dip process that, being a known technique, can easily be handled and can be used for the outer envelope of the lamp.

These and other aspects of the invention are apparent from and will be elucidated with reference to the embodiment described hereinafter. In the drawings:

FIG. 1 is a side elevation of a capped gas-discharge lamp for use in motor vehicle headlights.

The gas-discharge lamp 1 shown in side elevation in FIG. 1 is a high-pressure gas-discharge lamp for motor vehicle headlights that is usually referred to as a so-called MPXL lamp (micro-power xenon lamp). The lamp 1 has a cap 2 that is used to fit the lamp 1 into a motor vehicle headlight. For this purpose, the cap 2 is provided with receptacles and alignment marks (not shown) that enable the lamp 1 to be seated in a way in which it can be taken hold of, and to occupy an aligned position in the headlight. For reasons of clarity, the contacts arranged on the cap 2 for the external supply of power have not been shown either.

Fitted in the cap 2 is a burner 3 of quartz that comprises a first neck-shaped end 4, a discharge vessel 5, and a second neck-shaped end 6. The burner 3 is fixed in the cap 2 at its second neck-shaped end. Sealed into the neck-shaped ends 4, 6 that seal off the discharge vessel hermetically are respective electrodes 7, 8. The electrodes 7, 8 comprise an inner portion 81 composed of a tungsten wire that projects into the discharge vessel 5, a central portion 82 of molybdenum foil in the region of the hermetic seal, and an outer portion 83 composed of a tungsten wire for making contact. The outer portion 83 of the electrode 8 at the end remote from the cap 2 is connected to a contact in the cap 2 by a return wire 9. It is possible for the return wire 9 to be insulated with a ceramic pipe, but this is not shown in FIG. 1. A discharge arc 10 is produced in the discharge vessel 5 between the two inner portions of the electrodes 7, 8 when the lamp 1 is operating.

By means of a sleeve 12 that is solidly connected to the cap 2, an outer envelope 11 is mounted on the cap 2. For greater clarity, the known way in which the outer envelope 11 is mounted in the sleeve 12 has not been precisely shown. The outer envelope 11 is composed of quartz and is filled with air. The bottom region of the outer envelope 11 is coated with a blue compensating filter 13. The filter 13 extends over the cylindrical outer envelope 11 in the longitudinal direction from the cap 2 to the end of the outer envelope 11. On the circumference of the cylindrical surface of the outer envelope 11, the compensating filter 13 extends approximately over an angular range of 170°, which is approximately equally divided between the two sides.

When the lamp 1 is operating, a discharge plasma forms in the discharge chamber 14 formed by the discharge vessel 5, if the filling in the discharge vessel 5 is in a gaseous state due to excitation via the electrodes 7, 8. Since not all of the quantity of salts in the filling is in the gaseous state, a yellowish condensate 15 is produced and this deposits at the bottom of the discharge chamber 14. The light generated by the discharge arc 10 is discolored by the condensate 15, as a result of which there would be an area of a yellowish coloration in the beam. The coloration caused by the condensate 15 is corrected by the compensating filter 13 before an image of the discharge arc 10 is formed by a reflector or a projection system belonging to the headlight in which the lamp 1 is fitted. Hence, by using the lamp 1 according to the invention, what is produced by the headlight is a beam that, on the road, no longer has an area of yellowish coloration.

In the embodiment shown, the compensating filter 13 is applied in that bottom region of the cylindrical outer envelope 11 that covers an angular range of approximately 170° on the surface of the cylinder. Readily conceivable within the scope of the inventive concept are other embodiments in which the compensating filter 13 covers a greater or smaller angular range or is shorter in length. Particular requirements to be met by the headlight can be catered for in this way. However, the compensating filter must be at least sufficiently large for the yellowish coloration to be fully corrected in the imaged beam. Consequently, the shape of the compensating filter 13 may be adjusted to suit given imaging systems in headlights and to suit requirements that headlight manufacturers have.

The invention claimed is:

1. A gas-discharge lamp having a discharge vessel, two electrodes, a cap, an outer envelope, a filling in the discharge vessel comprising a metal halide, a condensate having a particular color formed in the discharge vessel, and an optical compensating filter partially coated on the outer envelope, the optical compensating filter being configured to compensate for the particular color so that a light output of the gas-discharge lamp has reduced coloration of the particular color.

2. The gas-discharge lamp as claimed in claim 1, wherein the compensating filter is applied in that region of the outer envelope that is the bottom region of the outer envelope when the lamp is fitted and operating.

3. The gas-discharge lamp as claimed in claim 1, wherein the compensating filter comprises an interference filter.

4. The gas-discharge lamp as claimed in claim 1, wherein the compensating filter comprises an absorption filter.

5. The gas-discharge lamp as claimed in claim 1, further comprising an additional optical filter for color shifting purposes.

6. The gas-discharge lamp as claimed in claim 1, wherein the compensating filter is applied in a region of the outer envelope that, in a lamp which is fitted and operating, the condensate.

7. The gas-discharge lamp as claimed in claim 1, wherein the coating forming the compensating filter is applied by a dip process.

8. A lighting unit, particularly for vehicle headlights, having a gas-discharge lamp as claimed in claim 1.

9. The gas-discharge lamp of claim 1, wherein the optical compensating filter extends over a circumference of the outer envelope at an angular range of approximately 170°.

10. The gas-discharge lamp of claim 1, wherein the optical compensating filter is equally divided between two sides of the outer envelope separated by a longitudinal axis at a lower portion of the outer envelope in an operating position.

11. The gas-discharge lamp of claim 1, wherein the optical compensating filter compensate for yellowish light so that a light output has reduced yellowish coloration.

* * * * *